US007503382B2

(12) United States Patent
Maezawa et al.

(10) Patent No.: US 7,503,382 B2
(45) Date of Patent: Mar. 17, 2009

(54) HEAT EXCHANGER

(75) Inventors: Takahide Maezawa, Toyoshina-machi (JP); Masanori Tsuji, Toyoshina-machi (JP)

(73) Assignee: GAC Corporation, Nagano (JP)

( * ) Notice: Subject to any disclaimer, the term of this patent is extended or adjusted under 35 U.S.C. 154(b) by 427 days.

(21) Appl. No.: 10/526,488

(22) PCT Filed: Sep. 10, 2003

(86) PCT No.: PCT/JP03/11535

§ 371 (c)(1),
(2), (4) Date: Mar. 4, 2005

(87) PCT Pub. No.: WO2004/025207

PCT Pub. Date: Mar. 25, 2004

(65) Prior Publication Data

US 2006/0048928 A1 Mar. 9, 2006

(30) Foreign Application Priority Data

Sep. 10, 2002 (JP) ..... 2002-263480

(51) Int. Cl.
*F28F 9/26* (2006.01)
*F28D 1/047* (2006.01)

(52) U.S. Cl. ..... 165/144; 165/150; 165/175; 165/176; 165/178

(58) Field of Classification Search ..... 165/144, 165/145, 150, 157, 176, 175, 178; 62/525
See application file for complete search history.

(56) References Cited

U.S. PATENT DOCUMENTS 1,622,703 A * 3/1927 Campbell ..... 165/176
1,817,978 A * 8/1931 Feldmeier ..... 165/176
2,715,019 A * 8/1955 Walter ..... 165/145

(Continued)

FOREIGN PATENT DOCUMENTS

JP 2000-249428 9/2000

(Continued)

OTHER PUBLICATIONS

English Translation of International Preliminary Examination Report.

(Continued)

*Primary Examiner*—Leonard R Leo
(74) *Attorney, Agent, or Firm*—Blank Rome LLP

(57) ABSTRACT

There is provided a heat exchanger including: a heat exchange section in which a plurality of flat tubes are arranged substantially in parallel in a minor axis direction at first intervals and in which fins are disposed between the flat tubes; and a header to which at least some flat tubes out of the plurality of flat tubes are connected, in a state where the at least some flat tubes are bent in the minor axis direction outside the heat exchange section and end parts of the at least some flat tubes are arranged substantially in parallel at second intervals that are narrower than in the heat exchange section, so that the minor axis direction and a central axis direction of the header are the same direction. With this heat exchanger, it is possible to distribute fluid to the individual flat tubes with more equal conditions so that the heat exchange efficiency can be increased.

11 Claims, 12 Drawing Sheets

U.S. PATENT DOCUMENTS 3,400,759 A * 9/1968 Legrand ..... 165/173
3,406,747 A * 10/1968 White ..... 165/157
3,433,298 A * 3/1969 Vollhardt ..... 165/157
3,999,602 A * 12/1976 Fewell et al. ..... 165/157
4,289,196 A * 9/1981 Jabsen et al. ..... 165/145
4,493,368 A * 1/1985 Gronnerud et al. ..... 165/159
4,497,363 A * 2/1985 Heronemus ..... 165/95
5,644,842 A * 7/1997 Coleman ..... 29/890.53
5,855,241 A * 1/1999 Aubry ..... 165/145
6,293,334 B1 * 9/2001 Ghiani ..... 165/173
6,311,768 B1 * 11/2001 Jamison et al. ..... 165/173
6,513,585 B2 * 2/2003 Brost et al. ..... 165/175

FOREIGN PATENT DOCUMENTS

JP 2000-356436 12/2000
JP 2001-272184 10/2001

OTHER PUBLICATIONS

International Search Report, Jan. 13, 2004.

* cited by examiner

PRIOR ART

PRIOR ART

HEAT EXCHANGER

TECHNICAL FIELD

The present invention relates to a heat exchanger used in a refrigeration apparatus, a cooling apparatus or the like, and to a method of manufacturing the same.

RELATED ART

Japanese Laid-Open Patent Publication No. 2000-249428 discloses a heat exchanger that uses flat tubes and is to be used in a refrigeration apparatus, a radiator, or the like. Its evaporator includes a plurality of flat tubes and corrugated fins, and is supplied with a refrigerant from a header to which the flat tubes are connected. To optimize the distribution of a liquid refrigerant that flows in, an injector is disposed in the header.

To increase the heat exchange efficiency when the fluid or coolant supplied to the header is distributed to the respective tubes in the heat exchanger, it is important to distribute the fluid equally into the respective tubes. In the evaporator (heat exchanger) 100 in the refrigeration apparatus shown in FIG. 14 includes a plurality of fins 104 extending in an up-down direction and a plurality of tubes 101 that are connected to fins and arranging in parallel in the up-down direction with end parts 101*a* of the respective tubes 101 being connected to an inflow header 102 and an outflow header 103, respectively.

In the heat exchanger 100, when a two-phase refrigerant F, in which a gas phase and a liquid phase are mixed, is supplied to the inflow header 102, the refrigerant F is distributed to the respective tubes 101 via the header 102, heat exchanging takes place with an external fluid via the tubes 101 and the fins 104 connected to the tubes 101 and the refrigerant F is outputted to the outflow header 103. The refrigerant F supplied to the inflow header 102 is affected by gravity and other factors within the header, and as shown by FIG. 14 which looks interior of the header 102, the distribution of the gas-phase refrigerant Fa and the liquid-phase refrigerant Fb becomes non-uniform, with the gas phase and the liquid phase tending to separate so that the liquid-phase refrigerant Fb proportion is high for the refrigerant F flows bottom side tubes 101*d* and the gas-phase refrigerant Fa proportion is high for the refrigerant F flows top side tubes 101*u*.

For this reason, inside the top side tubes 101*u*, the small amount of liquid-state refrigerant Fb soon evaporates, which means that in the remaining parts of the tubes 101*u* to the outflow header 103, heat exchanging cannot be carried out by the latent heat of the liquid-phase refrigerant Fb and only gas-phase refrigerant Fa is heated. Accordingly, it is no longer possible to achieve sufficient heat exchanging performance. Conversely, inside the bottom side tubes 101*d*, more than the required amount of liquid-phase refrigerant Fb is present, so that while sufficient heat exchanging performance is achieved, however, the refrigerant reaches the outflow header 103 includes liquid-phase refrigerant Fb that is yet to evaporate. This means that refrigerant in a state where liquid-phase refrigerant Fb is present is outputted from the heat exchanger 100, which lowers the overall efficiency of the heat exchanging system.

In particular, in a heat exchanger with a large heat exchanging capacity, it is necessary to connect a large number of tubes 101 to the headers 102 and 103, so that the headers 102 and 103 become long which makes the phase state of the refrigerant F more changeable inside the headers. Accordingly, it becomes more difficult to supply the refrigerant F in the same phase state to all of the tubes 101.

With a heat exchanger 120 shown in FIG. 15 that uses a plurality of flat tubes 121, the heat exchanger 120 is designed so that the inflow header 102 is horizontal to lessen the effects of gravity, and a jet orifice 125 is also provided at an inflow part of the header 102 that is supplied with the refrigerant F, so that the gas-liquid distribution (phase state) of the refrigerant F inside the header becomes more constant.

However, this type of header construction is not generally applicable and can only be adopted in a narrow range of applications. Also, although this method attempts to make the state of the refrigerant homogeneous inside the header, if the time and/or length passed inside the header is/are long, the effects of gravity on the state of the refrigerant F cannot be avoided and it will not be possible to supply refrigerant in a uniform state to the respective tubes. Also, the state inside the header 102 is greatly influenced by the state of the refrigerant F, such as the flow rate, when the refrigerant F flows into the inflow header 102, so that it is difficult to always obtain an optimal distributing performance for the entire operating range of the system. Accordingly, although the heat exchange efficiency is improved by using flat tubes, in view of the tendency for the phase state of the refrigerant supplied from the header to become unbalanced, the above heat exchanger does not make maximum use of the merit of using flat tubes. In addition, a mechanism that incorporates a jet orifice causes a reduction in the productivity of a heat exchanger, and since there is also an increase in costs, this is not an economic or favorable solution.

As shown in FIG. 16A, one possible solution may be using a refrigerant distributor 112 in a heat exchanger 110. The heat exchanger 110 uses round tubes or round pipes 111 as the heat exchanging tubes. Since end parts 111*a* of a plurality of the round tubes 111 can be connected on a spherical surface area of the refrigerant distributor 112, the size of the refrigerant distributor 112 becomes small and the state of the refrigerant supplied to the respective tubes tends becomes more uniform. In addition, as shown in FIG. 16B, it is possible to form branch parts of the same shape for distributing the refrigerant to the respective tubes 111 inside the refrigerant distributor 112. This means that it is possible to eradicate factors such as gravity that change the phase state of the refrigerant F, and the refrigerant F is expected to be distributed with an even phase state to the respective tubes 111.

However, in the case of flat tubes or flat tubes where the lengths in the major axis and the minor axis of the section differ, it is not possible to bend and arrange the tubes or pipes in three dimensions like round tubes.

It is an object of the present invention to provide a heat exchanger that can distribute a refrigerant or a fluid in a more equal state to a plurality of flat tubes (or flat pipes). It is a further object to provide, as a heat exchanger that uses a large number of flat tubes, a compact, low-cost heat exchanger that has higher heat exchange efficiency. It is yet another object to provide a heat exchanger that can improve the productivity of heat exchangers that use flat tubes, and a method of manufacturing the same.

DISCLOSURE OF THE INVENTION

The present invention provides a heat exchanger including: a heat exchange section in which a plurality of flat tubes are arranged substantially in parallel in a minor axis direction at first intervals with fins disposed between the flat tubes; and a header to which at least some flat tubes out of the plurality of flat tubes are connected in a state where the at least some flat tubes are bent in the minor axis direction outside the heat exchange section and end parts of the at least some flat tubes are arranged substantially in parallel at second intervals that are narrower than in the heat exchange section so that the minor axis direction and a central axis direction of the header are the same direction. Conventionally, a header distributes fluid to a plurality of tubes, with the header extending as far as the positions of the tubes subjected to the distribution, but conversely with the present invention, flat tubes are bent and grouped outside the heat exchange section, so that the headers are shortened. Accordingly, in the heat exchanger according to the present invention, the passing time and distance for the fluid inside the header are shortened, so that the effects of factors, such as gravity and the flow state, to the passing fluid inside the header, are lessened and it becomes possible to supply a liquid such as refrigerant to the plurality of flat tubes with a more uniform state and conditions.

In the case of round tubes, even if the round tubes are bent and gathered, the header length needs to be at least as long as the aligned tubes. Namely, the header needs to be at least as long as the diameter of the round tubes multiplied by the number of tubes, so that the rate of increasing the performance against the increasing man-hours for bending the pipes is small. On the other hand, with flat tubes, the minor axis diameter is a few times smaller than the major axis diameter. Accordingly, if flat tubes are gathered in the minor axis direction, some flat tubes can be connected to an area having the same length as the major axis diameter, and it is possible to distribute liquid to some flat tubes using the area having the similar size of the major axis diameter of the tubes. Accordingly, the header can be made much shorter, and liquid can be supplied with a more uniform state and conditions to a plurality of flat tubes.

By gathering the flat tubes, it is possible to attach the tubes to the header so that the major axis direction of the tubes is oriented in the central axis direction of the header. In this case, in view of the header being a pressure-resistant member that is round (pipe-shaped) in cross section, when the flat tubes are perpendicularly connected to the wall surface of the header, the flat tubes need to be disposed radially in the radial direction of the header. If the flat tubes are not disposed radially, the length by which the end parts of the tubes protrude inside the header will change and the angle made between the end parts of the tubes and the inside surface of the header will change depending on the positions at which the tubes are connected, so that even if the header is made shorter, the flow conditions near the openings of the respective tubes will vary greatly and the state and conditions of the fluid supplied to the respective tubes will be susceptible to change.

To attach the flat tubes to the header radially, it becomes difficult to machine the openings in the header and the process requires many man-hours. Since the bending angle of the flat tubes is determined one pipe at a time, designing also takes time and there is an increased burden for machining and assembly, making this construction unsuited to mass production. In addition, since the attachment angles of the respective pipes to the header differ, it is not possible to tightly attach the flat tubes together, and as the number of pipes increases, a header with a large diameter becomes necessary.

In the present invention, the flat tubes are connected to the header so that the minor axis direction is the same direction as the central axis direction of the header. With this method of attaching, since the end parts of the flat tubes are aligned in the central axis direction of the header, it is simple to make the lengths by which the end parts of the tubes protrude inside the headers uniform, and conditions, such as the angle made between the end parts of the tubes and the inside wall surface of the header, can be made equal. Accordingly, it is possible to supply fluid to the plurality of flat tubes with substantially the same conditions and state. It is therefore possible to make the phase state of the heat exchange medium distributed to the individual flat tubes uniform and the flow rate of the heat exchange medium passing through the respective flat tubes can be made equal, so that it is possible to sufficiently achieve the merits of using a small header and the heat exchange efficiency of the heat exchanger can be realized to the maximum.

Also, in a heat exchanging system that includes the heat exchanger according to the present invention and a means for supplying a heat exchange medium to the heat exchanger, even if the state of the heat exchange medium flowing into the header changes, there will be very little unbalancing of the state of the heat exchange medium supplied to the respective flat tubes, so that high heat exchange efficiency can always be achieved for the entire operating range of the system.

That is when the flat tubes are connected to the header so that the minor axis direction of the flat tubes is the same direction as the central axis direction of the header, the end parts can be arranged so as to be substantially parallel. By arranging the end parts so as to be parallel, the conditions of the plurality of end parts with respect to the header become equal, so that it is possible to distribute a fluid such as refrigerant with uniform conditions. In addition, by disposing flat end parts in parallel in the minor axis direction, the major axes diameters of each flat end parts become parallel, so that it is possible to make the intervals between the end parts narrower. This is preferable since the header becomes shorter so that fluid can be distributed with the same conditions, and can reduce the man-hours for attaching the end parts to the header.

In one aspect of this invention, the gaps between the end parts of the flat tubes connected to the header can be made approximately equal to the minor axis diameter of the flat tubes or smaller. It is also possible to arrange the end parts of the flat tubes so as to be substantially touching or thereabouts in the minor axis direction. If the gaps between the end parts of the plurality of flat tubes become narrow, it is possible to treat the end parts as a single bundle. After attachment to the header, at least at the part attached to the header, the end parts of the plurality of flat tubes are bunched into a single group and no longer move. In this case, the intervals between the flat tubes themselves at the end parts are extremely narrow compared to the tube length, so that if, for whatever reason, a force acts upon and tries to deform one flat pipe out of the bundled flat tubes, the nearby flat tubes hinder such deformation, so that the strength of the connection to the header is effectively increased and a highly reliable heat exchanger can be provided.

Also, in the heat exchanger of the present invention, the flat tubes that are arranged at the first intervals in the heat exchange section become closer at the second intervals close to the header, so that the pipe lengths of adjacent flat tubes from the heat exchange section to the header differ. Accordingly, since the vibration and resonance conditions for adjacent flat tubes differ, even in conditions where vibrations are transmitted from wheels or a motor, the heat exchanger may not resonate with such vibrations. Even if some of the tubes resonate, since the tubes are gathered at the end parts, vibrations of such resonance will be attenuated by interference between the nearby tubes, therefore a resonant sound and damaging of tubes and pipes are prevented.

When attaching the end parts of the flat tubes to a header, if the end parts of the flat tubes are bundled in advance, the bundled end parts of the flat tubes can be collectively connected to the header, so that the process of connecting the end parts of the tubes to the header becomes extremely simple.

Since the flat parts are bundled in the minor axis direction, by merely bending the individual flat tubes in the direction in which the flat tubes are arranged, the end parts of the flat tubes are gathered together easily. If the end parts of round tubes are bundled, there is no way to braze the end parts of the tubes positioned in the center of the bundle. In addition, if the round tubes are aligned in a row, an effectively bundled arrangement is not produced and since gaps are produced between the individual round tubes in the bundled state, the area efficiency is poor. Flat tubes can easily be bundled in the minor axis direction, and if there are slight gaps between the bundled end parts, the individual end parts can be connected to the header by brazing. If a state where there are hardly any gaps between the end parts can be produced, by filling the residual gaps with an appropriate material such as brazing, it will also be possible to attach the end parts of the plurality of flat tubes to the header together as one end part.

Also, since the area for connecting the flat tubes can be reduced by bundling the end parts with substantially no gaps, the header can be made more compact and it is possible to distribute fluid in more equal conditions and states to the individual flat tubes. By bundling the tubes, a heat exchange medium such as refrigerant can be supplied with the end parts of a plurality of flat tubes as the end part of a single tube, and it is also possible to make the state of the heat exchange medium that flows through the respective flat tubes more uniform.

In the heat exchanger including the heat exchange section in which the plurality of flat tubes are arranged in the minor axis direction and at least one header to which at least some flat tubes out of the plurality of flat tubes are connected in a bundled state in the minor axis direction, by bundling the plurality of end parts, it is possible to connect the end parts to the header in the state of a single group, so that the number of connections between the header and the plurality of flat tubes can be drastically reduced to one or only a few positions and the man-hours required to connect the header and the tubes can be reduced. This means that it is possible to reduce the manufacturing cost. In addition, the processing of the flat tubes when the end parts of the flat tubes are bundled in the minor axis direction is not three-dimensional processing and since two-dimensional processing in the minor axis direction is sufficient, no bending in the difficult major axis direction is required. This means that the machining of the flat tubes in the heat exchanger according to the present invention is extremely simple. Accordingly, although the end parts of the flat tubes may be placed adjacent to each other and attached to the header one by one, it is preferable to bundle end parts of at least some tubes out of the plurality of flat tubes (a first process) and to attach the end parts in the bundled state to the header (a second process).

The heat exchanger according to the present invention should preferably include a first header to which end parts at one end of the plurality of flat tubes are connected and a second header to which end parts at another end of the plurality of flat tubes are connected, with the first header and the second header being disposed with respect to the heat exchange section so that tube lengths of the plurality of flat tubes between the first header and the second header are substantially equal. By using the arrangement, it is possible to make the pressure loss in the individual tubes even more uniform, so that the state and amount of the heat exchange medium supplied to the individual flat tubes can be made even more uniform. In a heat exchanger that includes a first header to which end parts at one end of the plurality of flat tubes are connected and a second header to which end parts at another end of the plurality of flat tubes are connected, by disposing the first header and the second header on a diagonal with the heat exchange section in between, the tube lengths of the respective flat tubes between the headers can be made substantially equal. In the heat exchanger, the inputting and outputting of the heat exchange medium into the heat exchange section are arranged on opposite sides.

Also, in a heat exchanger that includes a first header to which end parts at one end of some of the plurality of flat tubes are connected, a second header to which end parts at the same end of other pipes out of the plurality of flat tubes are connected, and a third header to which end parts at the other end of the plurality of flat tubes are connected, by disposing the first and second headers at the corners of respective sides the heat exchange section and disposing the third header in a central part, it is possible to make the tube lengths of the flat tubes between the headers substantially equal. That is, in this heat exchanger, the first header and second header are disposed at the respective sides in the first direction outside the heat exchange section in which the flat tubes are aligned in the first direction, and the third header is disposed in the central vicinity in the first direction outside the heat exchange section. In the heat exchanger, the inputting and outputting of the heat exchange medium to the heat exchange section are arranged on the same side.

In addition, the present invention can be applied to a heat exchanger that is provided with a plurality of headers and further includes at least one distributor connected to the headers, with it being possible to use round pipes as the pipes between the distributor(s) and the plurality of headers.

BEST MODE FOR CARRYING OUT THE INVENTION

Figure 1:
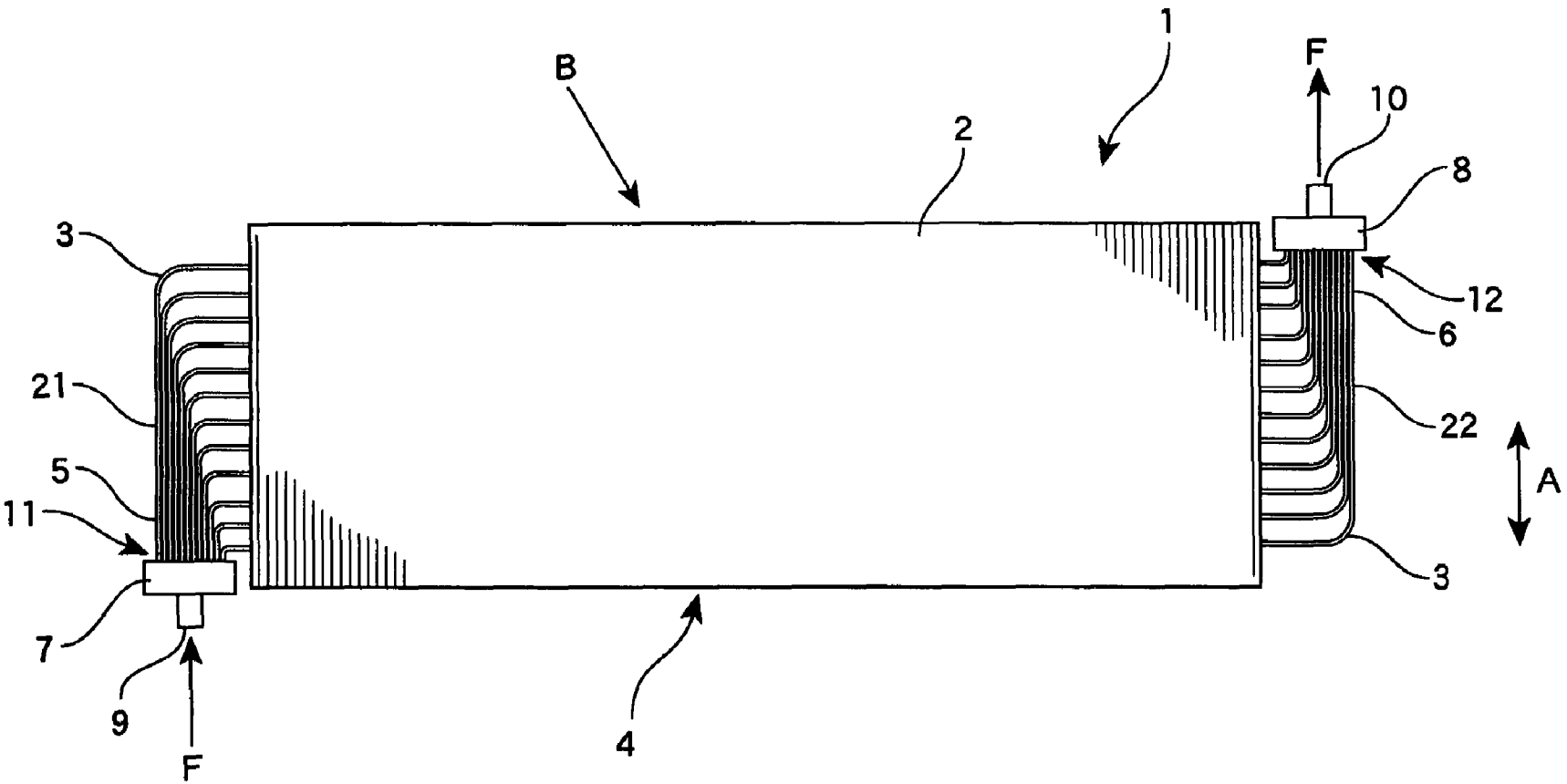
FIG. 1 is a diagram schematically showing a heat exchanger according to the present invention.

The present invention will now be described in more detail with reference to the drawings. FIG. 1 schematically shows a heat exchanger according to the present invention. The heat exchanger 1 is a so-called "plate fin-type heat exchanger" and includes a plurality of plate-like fins 2 that are disposed in parallel at fixed intervals and a plurality of flat tubes 3 that pass through and are attached to the fins 2 in parallel, with these parts constructing a heat exchange section (heat exchanging unit) 4. In the heat exchanger 1, both end parts 5 and 6 of the plurality of flat tubes 3 are arranged substantially in parallel at second intervals that are narrower than a first interval (pitch) of the flat tubes 3 inside the heat exchange section 4 and are respectively connected to headers 7 and 8 positioned to the left and the right. A heat exchange medium (hereinafter, "internal fluid") F such as a refrigerant, heat transfer medium, or the like supplied from a supply opening 9 of the header 7 on the inflow side is led via the respective flat tubes 3 to the output opening 10 of the header 8 on the outlet side, and while the internal fluid F flows in this way, heat exchanging takes place between the internal fluid F and an external fluid B such as air that flows outside the heat exchanger 1.

The fins 2 are disposed for increasing the contact surface area with the external fluid B to improve the heat exchange efficiency. By using flat tubes 3, the heat exchanging area of the tubes themselves is also increased. Accordingly, the heat exchange efficiency of the heat exchanger 1 that uses the flat tubes 3 is high. In addition, since the internal fluid F can be supplied with substantially the same conditions and in the same state to the respective flat tubes 3 by applying the present invention, it is possible to make the conditions of the internal fluid that passes the respective flat tubes 3 equal and it is possible to provide a heat exchanger 1 with even higher heat exchange efficiency.

Figure 2:
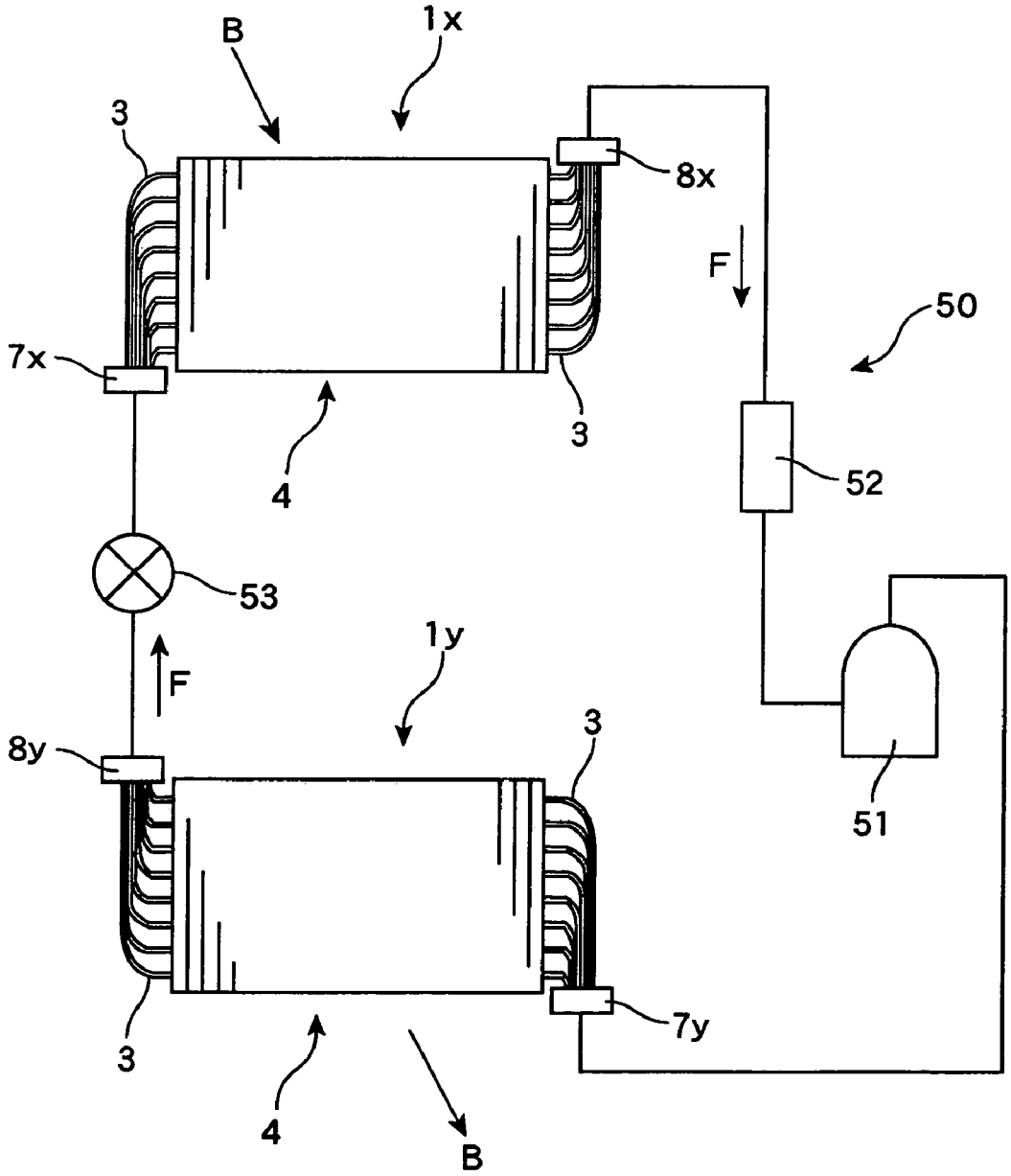
FIG. 2 is a diagram schematically showing a heat exchanging system in which the heat exchangers are used.

FIG. 2 shows a heat exchanging system 50 that uses the heat exchangers 1 of the present embodiment. The heat exchanging system 50 provides a heat exchanging cycle that is used in an air conditioning apparatus, a refrigeration apparatus, or the like. For example, in an air conditioning system, the heat exchanger can be used as an evaporator 1*x* that carries out heat exchanging between a refrigerant F in a liquid state and the air B to cool the air and as a condenser 1*y* that carries out heat exchanging between the refrigerant F in a compressed gas state and the air B to liquefy the refrigerant F. The heat exchanging system 50 also includes a compressor 51 to circulate and supply the refrigerant F to the heat exchangers 1*x* and 1*y*. In addition, the heat exchanging system 50 includes devices such as a receiver 52 that temporarily stores the refrigerant F and an expansion valve for expanding the refrigerant F supplied to the evaporator 1*x*. Either of the headers 7 and 8 of the heat exchangers 1 may be input header or output header. In the evaporator 1*x*, the lower header 7*x* is the inflow header and the upper header 8*x* is the outflow header 8*x*. On the other hand, in the condenser 1*y*, the upper header 8*y* is the inflow header and the lower header 7*y* is the outflow header.

Figure 3A:
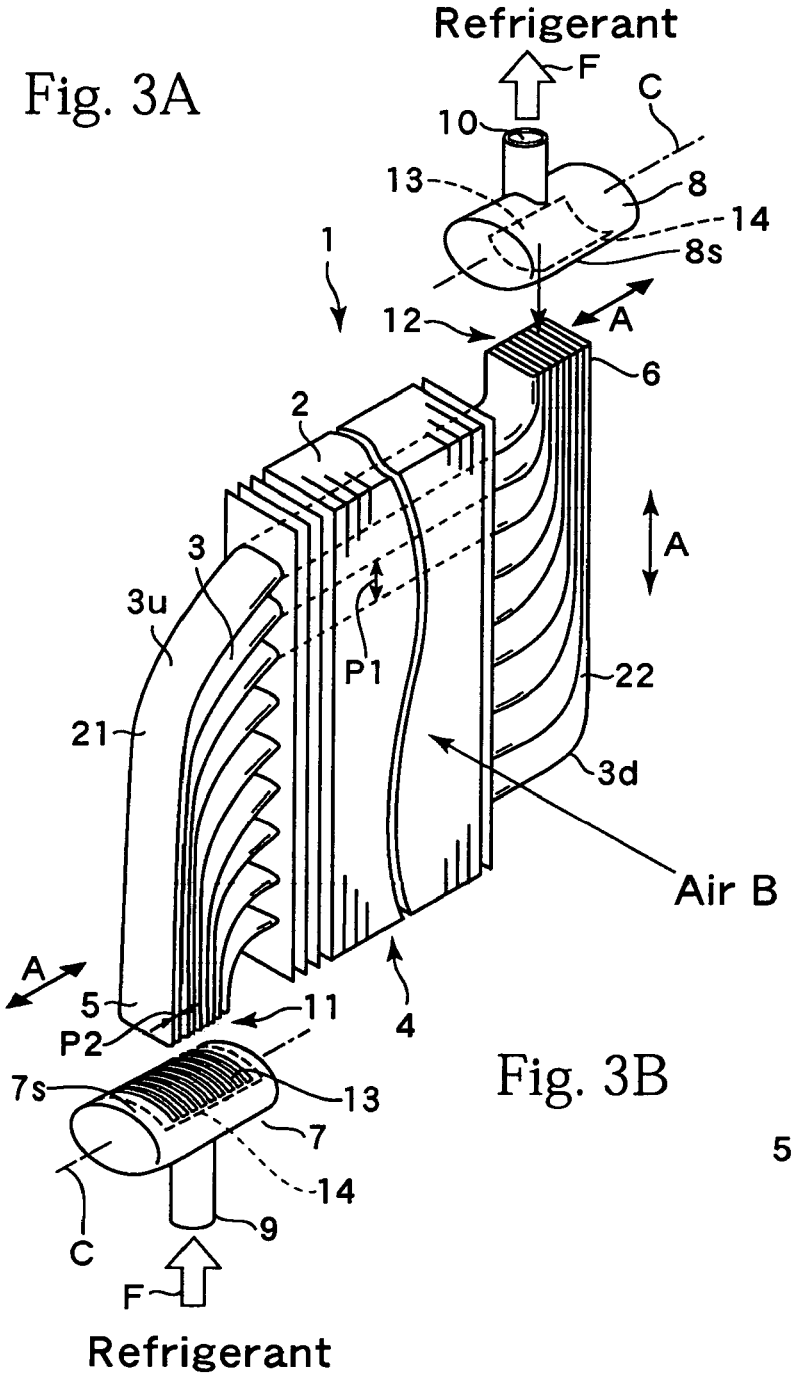
FIG. 3 are diagrams showing the heat exchanger in a state where the headers have been removed.
Figure 3B:
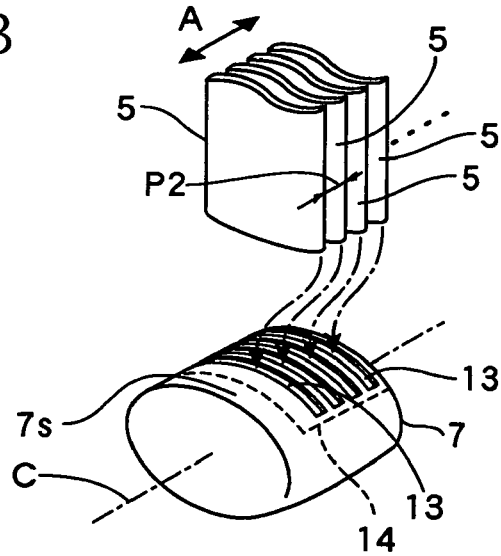

FIG. 3A shows a state where the respective headers 7 and 8 of the heat exchanger 1 have been disconnected. FIG. 3B shows an enlargement of the disconnected header 7 and end parts of the flat tubes. In the heat exchange section 4, the respective flat pipes or flat tubes 3 are disposed in parallel at first intervals P1 in the minor axis direction A which is the first direction. Parts 21 and 22 of the flat tubes 3 that protrude outwards from the heat exchange section 4 where the fins 2 are provided between the flat tubes 3 are respectively bend upwards and downwards in the minor axis direction A toward the headers 7 and 8. At the parts 21 on the left side of the heat exchange section 4 in FIG. 3A, the end parts 5 of the respective flat tubes 3 are gathered together so as to face downwards and be aligned or disposed in parallel in the horizontal direction at second intervals P2 that are narrower than the first intervals P1, with a part 11 being formed where the end parts 5 of the plurality of flat tubes are gathered in the minor axis direction. At the parts 22 on the right side of the heat exchange section 4 in FIG. 3A, the end parts 6 of the respective flat tubes 3 are gathered together so as to face upwards and be aligned or disposed in parallel in the horizontal direction at second intervals P2 that are narrower than the first intervals P1, with a part 12 being formed where the end parts 6 of the plurality of flat tubes are gathered in the minor axis direction. At these parts 11 and 12, the end parts 5 and 6 of the flat tubes 3 are disposed so as to being layered in the minor axis direction at the respective intervals P2. It should be noted that although the minor axis direction of the tubes 3 is the up-down direction inside the heat exchange section 4 and the minor axis direction of the flat tubes 3 is the horizontal direction at the parts 11 and 12 where the flat tubes 3 are bent and gathered outside the heat exchange section 4, the same symbol A is used for showing the minor axis direction.

In the heat exchanger 1 according to the present embodiment, the end parts 5 of the respective flat tubes 3 are connected to substantially rectangular joining holes or attachment holes 13 that are provided in the respective headers 7 and 8. The end parts 5 that point downwards on the left of the respective flat tubes 3 are connected to the attachment holes 13 provided so as to face upwards in the inflow header (the first header) 7, and the end parts 6 that point upwards on the right are connected to the attachment holes 13 provided so as to face downwards in the outflow header (the second header) 8. These attachment holes 13 are equal to in size or slightly larger than a cross section of the end parts 5 of the flat tubes 3 respectively and after the ends of the end parts 5 have been inserted into the attachment holes 13, the flat tubes 3 are fixed to the headers 7 and 8 by brazing. To attach the plurality of end parts 5 to the headers 7 and 8 by this method, the headers 7 and 8 are each provided with a connection region 14 in which the plurality of attachment holes 13 are disposed in parallel at narrow intervals.

Figure 4:
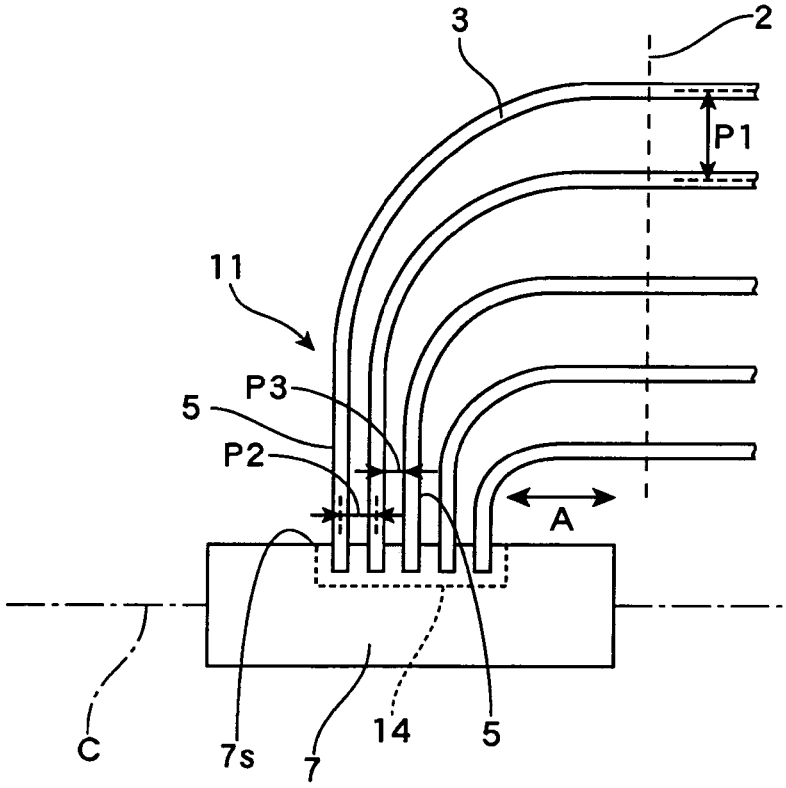
FIG. 4 is a diagram showing an enlargement of end parts of flat tubes of the heat exchanger.

The headers 7 and 8 are substantially cylindrical to achieve a pressure-resistant construction, and the respective end parts 5 and 6 of the flat tubes 3 are disposed at intervals P2 in the minor axis direction A so that the minor axis direction A becomes parallel with a central axis direction C of the headers 7 and 8. As shown in FIG. 4, in the heat exchanger 1, flat tubes 3 with an external diameter in the minor axis direction of 1.9 mm are used, the intervals P2 (the distance from center to center in the minor axis direction) of the flat tubes 3 is set at approximately double the external diameter in the minor axis direction at 3.7 mm, and the gaps P3 between the flat tubes 3 are set 1.8 mm that is substantially equal to the external diameter of the minor axis that makes the flattened shape. The respective headers 7 and 8 only need to be of a sufficient size or length for joining the parts 11 and 12 that are disposed at the narrow intervals P2. Therefore, compared to a case where end parts disposed at intervals of P1 in the heat exchange section 4 are joined to headers without bending, the headers 7 and 8 are extremely short. This means that fluctuations in the state of the internal fluid F within the headers can be suppressed. The distances between the respective end parts of the flat tubes 3 are reduced, so that the phase states and other conditions are substantially equal for the respective flat tubes 3. Therefore, substantially equal conditioned internal fluid F can be supplied under substantially equal conditioned connection state between the headers and the flat tubes 3.

That is, in the present embodiment, the end parts 5 and 6 of the flat tubes are respectively connected to the headers 7 and 8 in a state where the minor axis direction A matches or is parallel with the center axis direction C of the headers 7 and 8. When focusing on the end parts 5 at one end of the tubes, for example, for the end parts 5 of a plurality of the flat tubes, the conditions (the shape, the angle, the length of the tube end part that protrudes into the header, and the like) are the same for the all end parts that pass through the circumferential surface 7*s* of the header 7, so that the refrigerant F can be supplied with the same conditions from the header 7 to the respective flat tubes 3. In addition, the header 7 is short and the flat tubes 3 are disposed in parallel in the minor axis direction, so that the distance between adjacent end parts 5 is extremely short at around the length in the minor axis. This means that the refrigerant can be supplied to a plurality of tubes 3 with the same conditions and in the same state without the state of the refrigerant F changing between end parts 5 of the plurality of flat tubes 3.

If the conditions and state of the refrigerant supplied to the respective flat tubes 3 are made uniform, the conditions of the heat exchanging that takes place for the respective flat tubes 3 also become equal, so that the heat exchanging load is evenly distributed among all of the flat tubes 3 and the heat exchange efficiency of the heat exchanger 1 can be improved. This means that the heat exchange efficiency of a heat exchanger 1 that uses flat tubes can be further improved and when the heat exchanger 1 is used in the system 50, even when the state of the internal fluid F that flows into a heat exchanger 1*x* or 1*y* changes, there is no large deterioration in the performance of the heat exchanger 1 and stable performance can be realized within the range of the operating conditions.

In addition, it is possible to provide gaps that are equal to the width of the flat tubes 3 in the minor axis between adjacent flat tubes 3, and by using these gaps, it is possible to sufficiently carry out a joining operation, such as brazing, for the end parts and the headers. Also, with the heat exchanger 1, the end parts 5 of the plurality of flat tubes 3 are parallel, so that the bending process and the brazing operation are easy.

Using the header 7 as an example, the gaps between the end parts 5 of the flat tubes connected to the header 7 are equal to or smaller than the diameter of the flat tubes in the minor axis direction, so that the plurality of end parts 5 appear to be gathered together into a single bundle. As one example, if, for whatever reason, a force acts upon and tries to deform one flat pipe out of the plurality of flat tubes 3 attached to the connection region 14 of the header 7, the nearby flat tubes 3 that are fixed to the connection region 14 in a bundle hinder such deformation, so that the connection strength of the respective end parts 5 to the header 7 is effectively increased. Accordingly, a highly reliable heat exchanger can be provided.

In the heat exchanger 1, the tube lengths of adjacent flat tubes from the heat exchange section 4 to the header 7 differ. Accordingly, since the vibration and resonance conditions for adjacent flat tubes 3 differ, even in conditions where vibrations are transmitted from wheels or a motor, there is little possibility of the heat exchanger 1 resonating with such vibrations. In addition, even if some tube resonates, since the tubes are gathered at the end parts 5, vibrations due to such resonance will be attenuated by interference from the nearby tubes, and so the resonance will not develop to the stage where a resonant sound is produced or the pipes are damaged.

Figure 5:
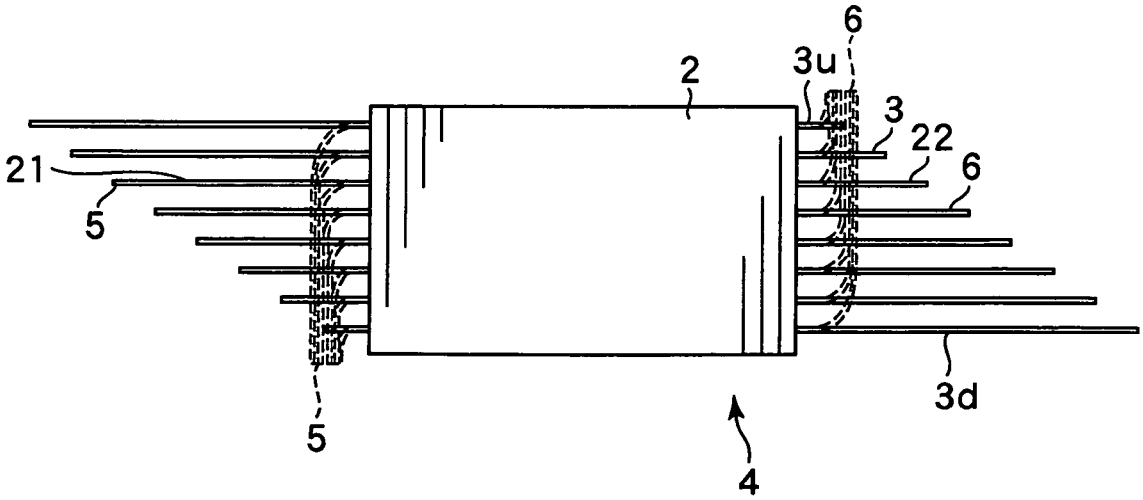
FIG. 5 is a diagram showing how the flat tubes are bent.

In FIG. 5, the solid lines show parts 21 and 22 of the flat tubes 3 that are outside the heat exchange section 4 before bending in the minor axis direction A, while the broken lines show the tubes after bending. In this heat exchanger 1, the headers 7 and 8 are disposed at positions on a diagonal with the heat exchange section 4 in between. Therefore, the pipe length from the header 7 to the header 8 is substantially equal for the respective flat tubes 3. For the flat tube 3*u* positioned closest to the top, the part 21 that protrudes from the fins 2 (outward) to the left is the longest compared to the other flat tubes 3, but the part 22 that protrudes from the fins 2 (outward) to the right is the shortest compared to the other flat tubes 3, so that the length is substantially equal to the lengths of the other flat tubes 3. In the same way, for the flat tube 3*d* positioned closest to the bottom, the part 21 that protrudes from the fins 2 to the left is the shortest compared to the other flat tubes 3, but the part 22 that protrudes from the fins 2 to the right is the longest compared to the other flat tubes 3. For the other flat tubes 3 also, by disposing the headers 7 and 8 at opposite ends on a diagonal, the left part 21 becomes shorter and the right part 22 becomes longer in order for the respective flat tubes 3 disposed from top to bottom, so that the lengths of the flat tubes 3 become substantially equal.

If a plurality of flat tubes are merely gathered together and connected to a header, it is possible to dispose the left and right headers 7 and 8 above, below or in the center, but when doing so, the lengths of the flat tubes become non-uniform that causes pressure lose differences in the respective flat tubes. In the heat exchanger 1 according to the present embodiment, the respective headers 7 and 8 are disposed at opposite positions on a diagonal with the heat exchange section 4 in between, so that the tube lengths from the inflow side header 7 to the outflow side header 8 can be made substantially equal and the pressure loss for the internal fluid F in the respective flat tubes 3 can be made substantially equal. Accordingly, the flow rate of the internal fluid F that flows in the respective flat tubes 3 tends to be equal. This means, in addition to the compact headers 7 and 8, the state of the internal fluid F flowing in the respective flat tubes 3 can be made uniform. By making the tube lengths of the flat tubes 3 equal, the pressure loss in the flat tubes 3 can be made substantially equal, so that the conditions for heat exchange in the respective flat tubes 3 can be made even more uniform. Accordingly, it is possible to provide a heat exchanger that has even higher heat exchange efficiency and can achieve a stabilized performance.

Figure 6:
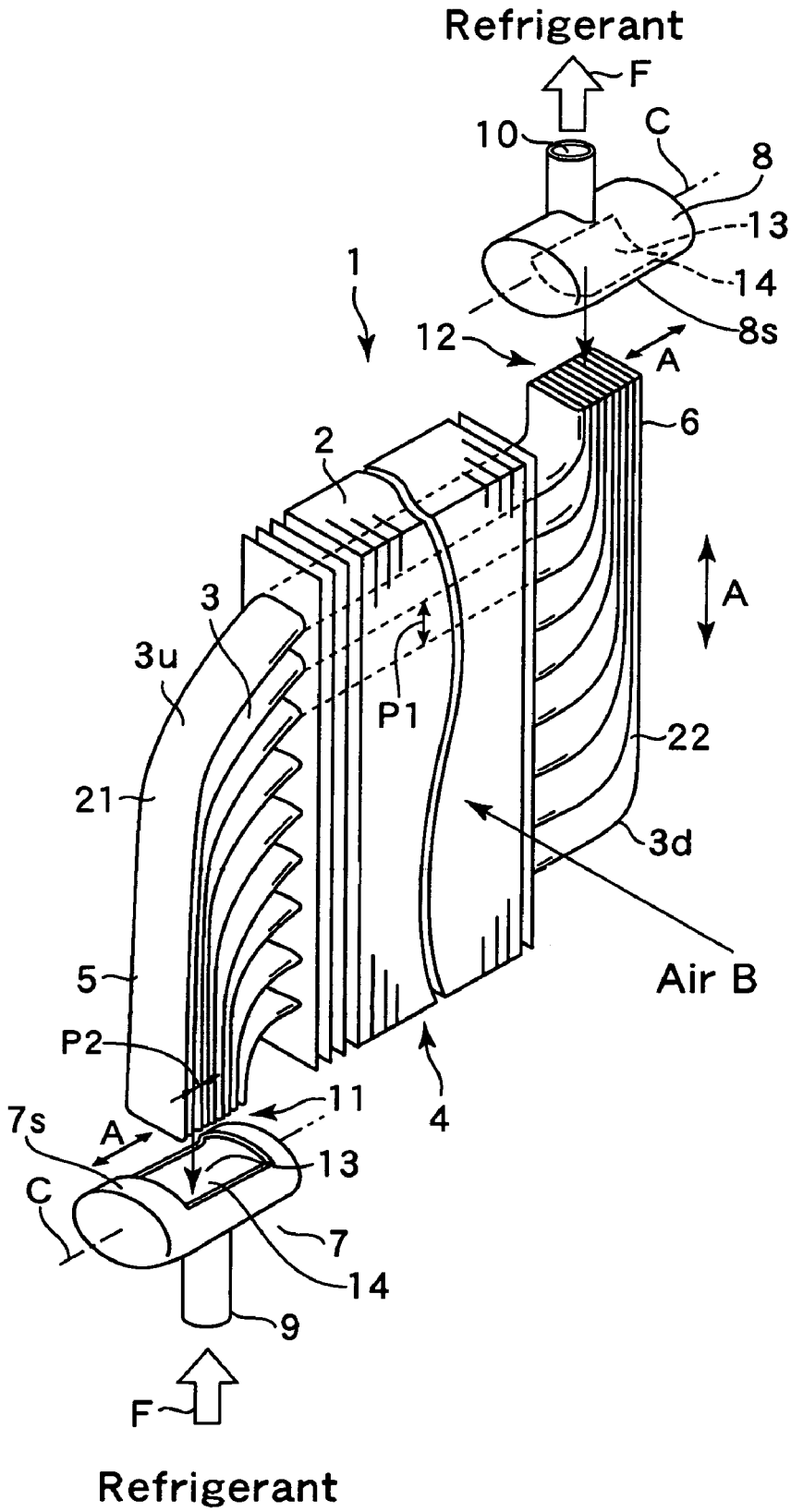
FIG. 6 is a diagram showing a heat exchanger where end parts of the flat tubes are to be connected to headers in a bundled state.

FIG. 6 shows a heat exchanger 1*a* where the end parts 5 and 6 of the flat tubes 3 are bundled together and connected as single groups to the headers 7 and 8. In this heat exchanger 1*a*, at the end parts 5 and 6 of the plurality of flat tubes 3, the intervals P2 of the end parts are narrowed to a state where the end parts 5 or 6 of adjacent flat tubes are in a substantially contacting state, with it being possible to treat connecting parts 11 and 12, which are composed of the end parts 5 or 6 of the plurality of tubes gathered together in the minor axis direction, as single connecting parts (end parts). That is, at these bundled parts 11 and 12, the end parts 5 and 6 of the flat tubes 3 are gathered together in respectively stacked states with substantially no gaps in between, resulting in a state where the parts 11 and 12 can be treated as the end parts of a single virtual tube respectively with a substantially quadrangular cross section. The plurality of end parts 5 and 6 are disposed with substantially no gaps in between inside this virtual tube.

In the heat exchanger 1*a*, the parts 11 and 12 where tubes are bundled into the single virtual tube with a substantially quadrangular shape are respectively integrally connected to the headers 7 and 8, so that attachment holes 13 that are substantially quadrangular are formed in the connection regions 14. The respective end parts 5 and 6 that compose the bundled parts 11 and 12 are not individually connected to the headers 7 or 8, and instead the bundled parts 11 and 12 are respectively connected to the headers 7 or 8 as single parts or in groups.

In the heat exchanger 1*a*, the regions 14 connected to the end parts 5 and 6 becomes as compact as possible, with it being possible to use extremely small headers 7 and 8 that are only large enough to join the bundled parts 11 and 12. This means that the internal fluid F becomes distributed more uniformly from the headers to the plurality of flat tubes.

Figure 7:
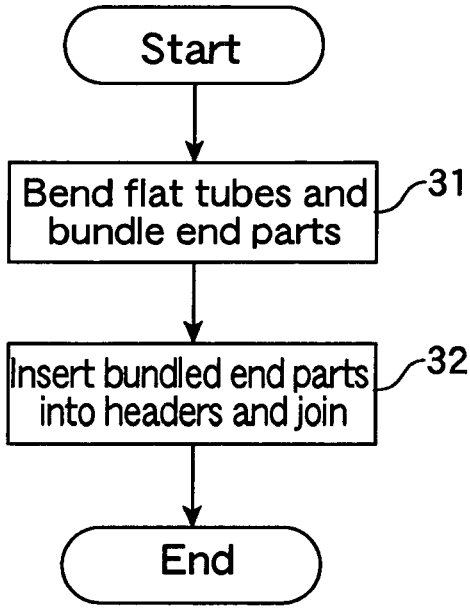
FIG. 7 is a flowchart showing a method of manufacturing a heat exchanger according to the present invention.

FIG. 7 is a flowchart showing a method of manufacturing the heat exchanger 1*a*. The manufacturing process of the heat exchanger 1*a* according to the present embodiment can be roughly divided into two stages, a first process 31 that bends the parts 21 and 22 that protrude outwards from the fins 2 in the minor axis direction A and a second process 32 that joins the end parts 5 and 6 of the respective tubes 3 to the headers 7 and 8. First, in the first process 31, as shown in FIG. 5, the plurality of flat tubes 3 are passed through the plurality of fins 2 that have been disposed in parallel. At this time, as described above, flat tubes 3 of the same length are assembled so that the amounts protruding to the outside differ. Next, as shown by the broken lines in FIG. 5, out of the parts 21 and 22 that protrude outwards from the fins 2, the parts 21 protruding to the left are bent downward. At this time, the end parts 5 of the plurality of tubes 3 are bundled in the minor axis direction A to form an integrated connecting part 11 for connecting to a header. The parts 22 protruding to the right are bent upward, and the end parts 6 of the plurality of tubes 3 are bundled in the minor axis direction A to form an integrated connecting part 12.

Next, in the second process 32, the connecting parts 11 and 12 are joined to the attachment holes 13 of the headers 7 and 8. By doing so, the heat exchanger 1*a* is manufactured. That is, in the present embodiment, instead of individually connecting the end parts 5 and 6 of the plurality of tubes 3, bundled connecting parts 11 and 12 can be collectively inserted into the attachment holes 13 and the tubes 3 and the headers 7 and 8 can be joined. This means that single holes 13 are sufficient for bonding the end parts 5 and 6 to the headers 7 and 8, and there is no need to provide a plurality of holes in the headers for joining the end parts of the individual flat tubes. By doing so, the number of steps carried out when joining the plurality of flat tubes can be reduced. Also, the size of the headers required for such joining is also reduced.

A variety of joining methods are available. As a representative method, there is a method where the bundled connecting parts 11 and 12 are inserted into the attachment holes 13 of the headers 7 and 8 as a provisional assembly, and then the provisional assembly is placed in a high-temperature oven so that the fins 2, the flat tubes 3, and the headers are integrated by brazing. There is also a method that mechanically expands the flat tubes 3 to join the flat tubes 3 to the fins 2, but in this case, after the fins 2 and the flat tubes 3 have been joined, it is necessary to carry out a process that joins the end parts of the flat tubes 3 to the connecting parts 11 and 12 and the headers 7 and 8 as a dedicated process. In this case also, the bundled connecting parts 11 and 12 can be attached as single groups to the headers 7 and 8 by brazing or the like. Accordingly, the number of connections between the flat tubes and the headers is extremely low, and in the present embodiment is one position per header irrespective of the number of flat tubes. This means that compared to a heat exchanger where round pipes are connected to a refrigerant distributor, it is possible to reduce the number of connections, so that the productivity of the heat exchanger 1*a* can be increased.

With the former method, even if the number of connections is large, the joining, including the joining of the headers and the tubes, can be carried out together by brazing using a high-temperature oven, so that there is no large increase in the number of connecting processes. However, in view of the process of provisionally assembling the individual tubes in the headers, same as in the case of round tubes, the task of provisionally placing a tube in the header has to be carried out a number of times equal to the number of tubes. On the other hand, with the heat exchanger 1*a* according to the present embodiment, the task of provisionally placing a tube in the header is not carried out a number of times equal to the number of tubes, but in units of the bundled end parts, that is, for a total of only two positions. Accordingly, even with the former joining method, it is possible to increase the productivity of a heat exchanger by adopting the present invention.

In the first process 31, by bundling the end parts 5 and 6 of the flat tubes 3 in the minor axis direction, it is not necessary to bend the tubes in the major axis direction, which facilitates the bending of the flat tubes. That is, in the heat exchanger 1*a* according to the present embodiment, no process that bends the flat tubes in three dimensions is carried out and by merely carrying out a process that bends the flat tubes in two dimensions in the minor axis direction, it becomes possible to connect the plurality of flat tubes to small headers. Accordingly, this also increases the productivity of a heat exchanger according to the present invention.

Airtightness can be maintained for the connections between the bundled flat tubes 3 and the headers 7 and 8 by brazing, solder, or adhesive (such materials are hereinafter collectively referred to as "sealant"). Also, in addition to the gaps between the flat tubes 3 and the attachment holes 13 of the headers, sealant should preferably be inserted into gaps between the bundled flat tubes themselves to achieve a sufficient airtightness. To do so, it is believed that the gaps P3 should be 3 mm or below. That is, the required cross-sectional form of the flat tubes 3 should preferably be such that a maximum gap between the flat tubes 3 at the bundled state is 3 mm or below.

Figure 8A:
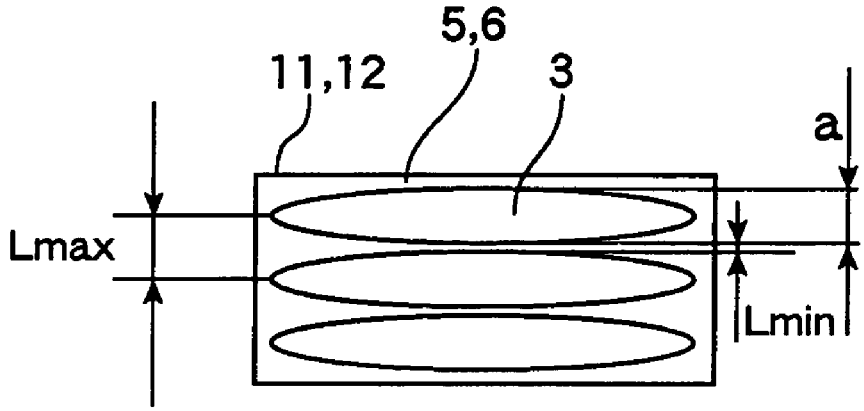
FIG. 8 shows diagrams useful in explaining shapes of the flat tubes that are suited to the case where the flat tubes are connected to the headers in a bundle.
Figure 8B:
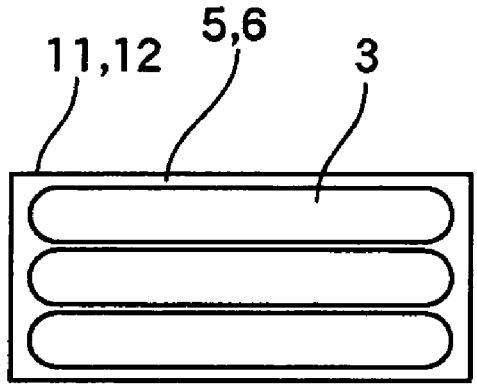
Figure 8C:
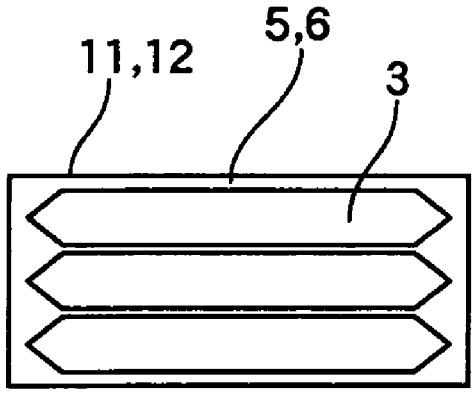

As shown in FIG. 8A, when the cross section of the flat tubes 3 is oval, that is, when the tubes are gathered together via curved surfaces that are arc-shaped cross sections, the maximum gaps Lmax between the tubes are at both ends in the major axis direction of the flat tubes. If the minor axis diameter of the flat tubes 3 is "a" and the gap at the center part in the major axis direction is Lmin, Lmax is (a/2+Lmin+a/2) and Lmax should be equal or less than 3 mm. Ideally, if Lmin=0, the result "a" being equal or less than 3 mm is obtained. This is the same when the cross-section of the flat tubes 3 is elliptic as shown in FIG. 8B, or another shape that satisfies the above as shown in FIG. 8C. When the tubes are bundled together, the end parts 5 and 6 of the respective tubes 3 are bundled together with fixed intervals, but so long as the cross-section is not completely rectangular, the gap will be largest at both ends in the major axis direction of the tubes. Accordingly, the cross-sectional shape of the flat tubes 3, which is suited to the case where the flat tubes 3 are bundled and connected, should preferably be such that the minor axis diameter is 3 mm or below.

In the heat exchanger 1*a*, since flat tubes 3 are used and moreover these flat tubes 3 are bundled in the minor axis direction, the tubes 3 can be gathered together in a state where there are few gaps between the end parts of the respective tubes 3. That is, the end parts of the respective tubes 3 can be bundled together with gaps that make it possible for airtightness to be maintained with a sealant such as brazing or adhesive, so that the bundled parts 11 and 12 become extremely compact. In addition, the headers only need to be provided with single attachment holes 13 for joining the bundled parts 11 and 12, and a plurality of the flat tubes 3 can be connected with single attachment holes 13. Accordingly, it is possible to use headers 7 and 8 that have small surface areas and small volumes. In a heat exchanger that uses flat tubes, which conventionally were difficult to bend compared to round tubes and could not be compactly gathered together, by bundling the tubes using the flatness of the tubes, it is possible to provide a heat exchanger that is more compact and has higher heat exchange efficiency than a heat exchanger that uses round tubes.

Figure 9A:
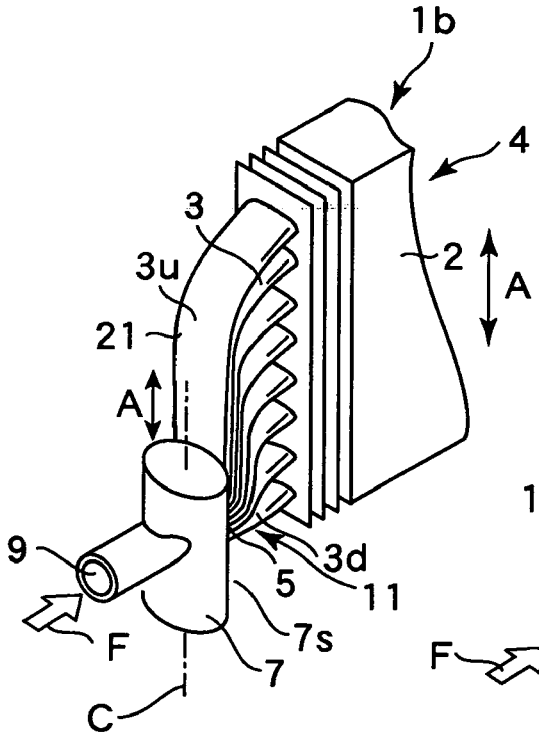
FIG. 9A is a diagram showing a different example of a heat exchanger and FIG. 9B is a diagram showing a state where a header has been removed.
Figure 9B:
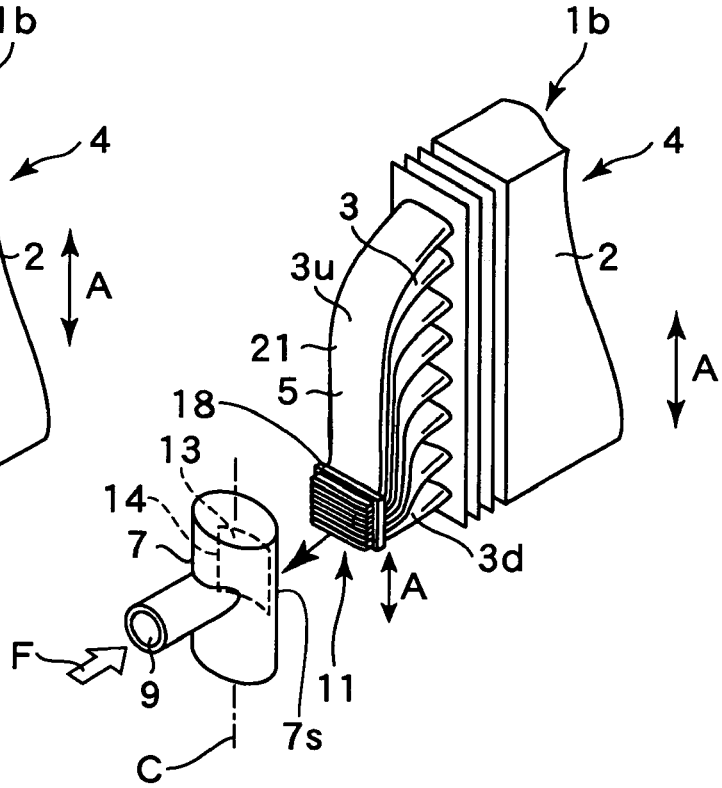

It should be noted that the present invention, which disposes the end parts of a plurality of flat tubes in parallel at intervals P2 that are narrower than the intervals P1 in the heat exchange section 4 and connects the flat tubes to the headers so that the minor axis direction A of the end parts 5 and 6 is the same direction as the central axis direction C of the headers 7 and 8, is not limited to the examples described above, and a variety of variations are thought possible. For example, FIG. 9A shows a state where a header has been attached in a different direction to that described above, while FIG. 9B shows the state where the header has been removed. In the heat exchanger 1*b*, the end parts 5 of the flat tubes 3 are aligned to face horizontally and the end parts 5 are bundled in the vertical direction. The connecting part 11 is connected to the header 7, whose central axis C is in the vertical direction, so that the minor axis direction A of the end parts 5 is in the same direction as the central axis direction C. In this example, the end parts 5 of the pipes 3 are bundled together using a connecting plate 18 and the connecting plate 18 can be brazed to the attachment hole 13 of the header 7 so that a plurality of flat tubes 3 can be collectively attached to the header 7. In addition, when the end parts 5 are attached using the connecting plate 18, it is possible to braze the individual end parts 5 from the rear side (the side that becomes an inner surface of the header 7) of the connecting plate 18, so that it is possible to dispose the end parts 5 even closer together.

Figure 10A:
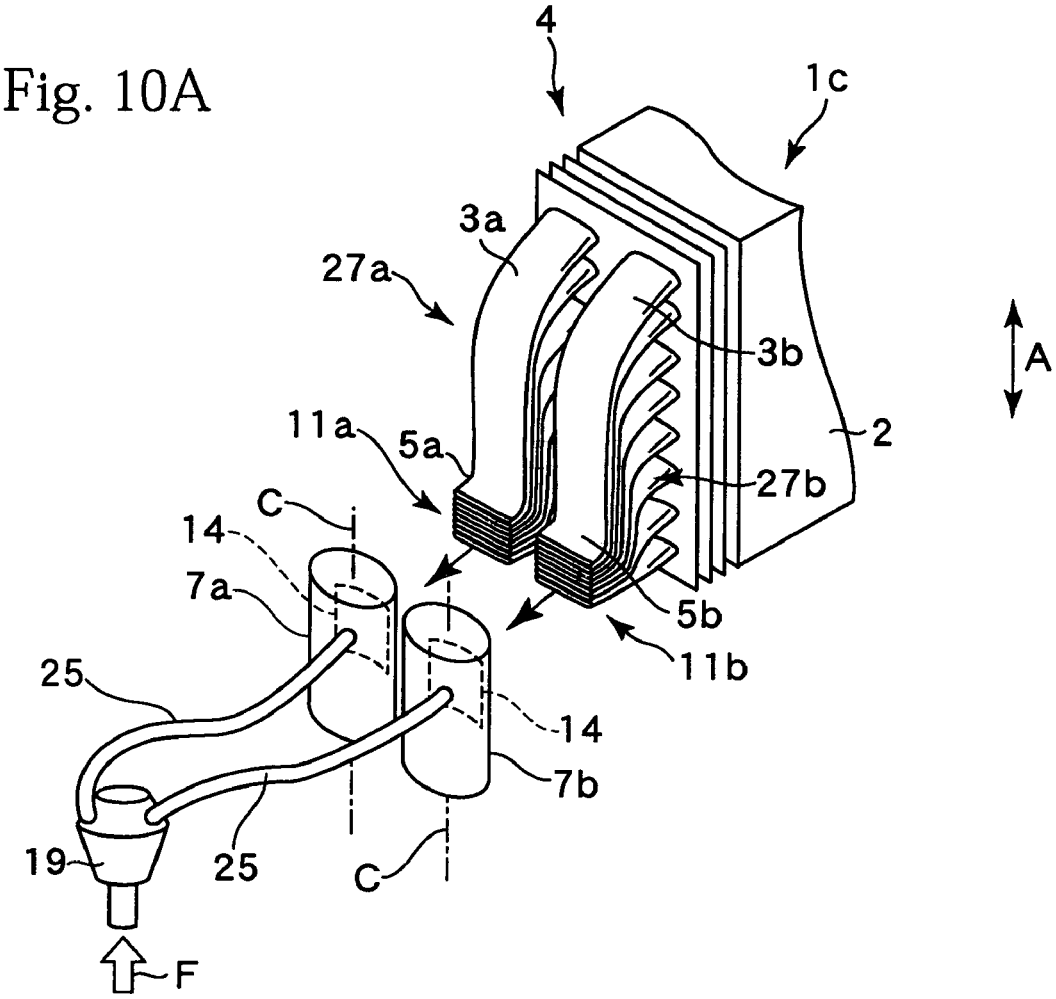
FIG. 10A is a diagram schematically showing a heat exchanger where two sets of flat tubes are attached to different headers.

FIG. 10A shows a heat exchanger 1*c* including circuits 27*a* and 27*b* in which two sets of flat tubes 3 are respectively disposed in the minor axis direction A. In the heat exchanger 1*c*, the connecting parts 11*a* and 11*b* of the respective circuits 27*a* and 27*b* are connected to different headers 7*a* and 7*b*. In addition, the respective headers 7*a* and 7*b* are connected to a single refrigerant distributor 19 by round tubes 25. By combining the distributor 19 and the plurality of headers 7, it is possible to distribute the refrigerant substantially uniformly to a larger number of flat tubes 3.

Figure 10B:
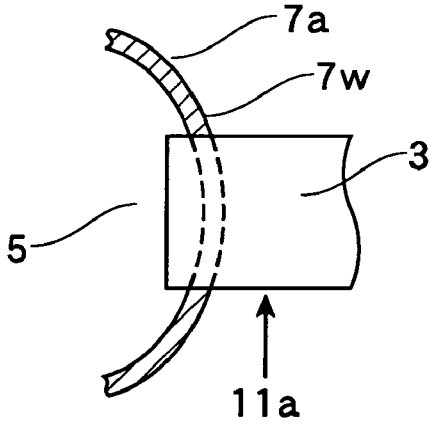
FIG. 10B is a diagram showing a cross-section taken perpendicular to the central axis of a header.
Figure 10C:
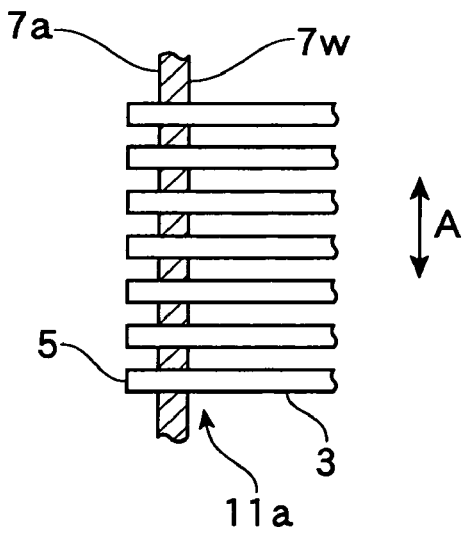
FIG. 10C is a diagram showing a cross-section taken parallel to the central axis of the header.

The cross-sections shown in FIGS. 10B and 10C show how the end parts 5 of the plurality of flat tubes 3 are bundled in the minor axis direction A and are attached to the outer wall 7*w* of the header 7*a* so that the minor axis direction A matches the central axis direction C of the header 7*a*. The end parts 5 of all of the tubes 3 that compose the connecting part 11*a* are attached in the same state to the internal surface of the wall 7*w* and the fluid that flows through the header 7*a* is distributed to all of the tubes 3 in substantially the same state and conditions.

Figure 11A:
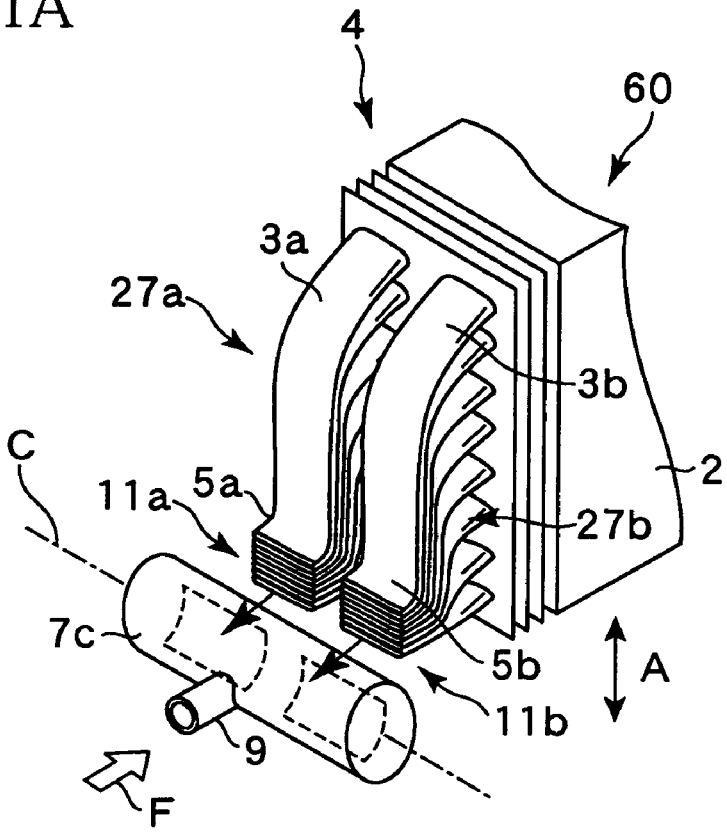
FIG. 11A is a diagram schematically showing a heat exchanger where two sets of flat tubes are attached to the same header and FIG. 11B is a diagram showing a cross-section taken perpendicular to the central axis of the header.
Figure 11B:
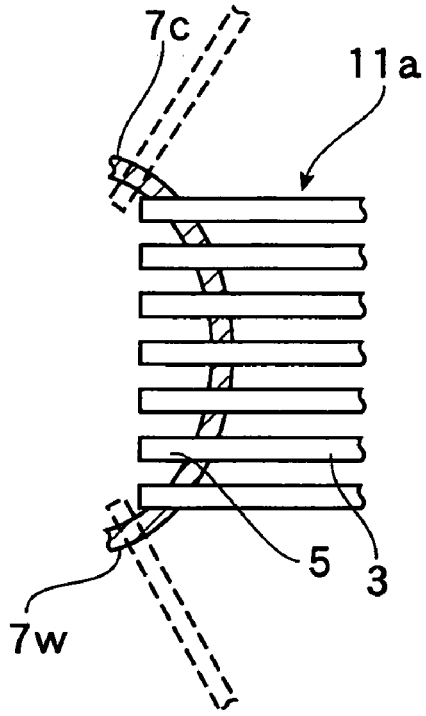

FIG. 11A shows a heat exchanger 60 in which two connecting parts 11*a* and 11*b* are connected so that the major axis direction of the flat tubes 3 matches or is parallel to the central axis direction C of a single header 7*c*. End parts of a plurality of sets of flat tubes 3 can be connected to a single header 7*c*. However, as shown in FIG. 11B, in view of the cross section of the header 7*c* to which the connecting part 11*a*, at which a plurality of end parts 5 are disposed in parallel in the minor axis direction, is attached, the lengths by which the ends of the end parts 5 protrude into the header 7*c* differ and the angles between the outer wall 7*w* of the header 7*c* and the respective end parts 5 also differ. Accordingly, only fluid that flows near the outer wall 7*w* of the header 7*c* is distributed to the top and bottom flat tubes 3 of the connecting parts 11*a*. In addition, in the case where the fluid flows along the internal surface of the wall 7*w*, since the direction in which the fluid flows and the orientation of the openings in the end parts 5 differ for each tube, even if the end parts 5 are disposed adjacent to one another in the up-down direction, the conditions and state of the refrigerant that flows into the respective tubes 3 from the header 7*c* also differ. If the end parts 5 are attached in the radial direction as shown by the broken lines, the differences between the tubes are lessened, but such attaching method is troublesome and the arrangement of tubes is complex, with it also being difficult to bundle the end parts 5.

Figure 12:
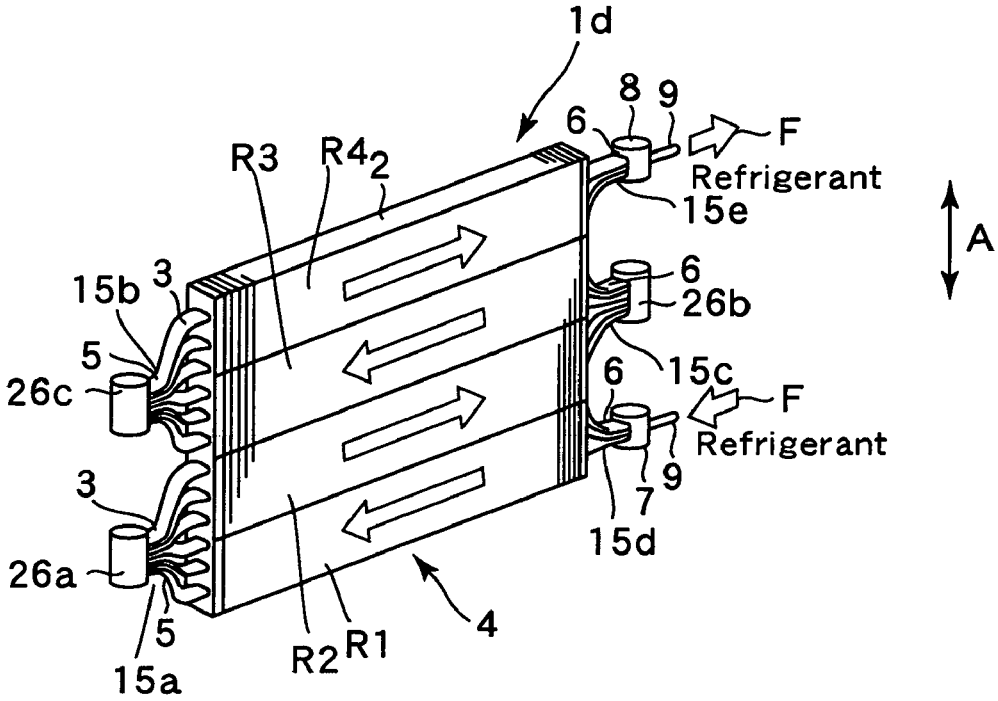
FIG. 12 is a diagram showing an example of a heat exchanger that uses U-turn headers.

The heat exchanger 1*d* shown in FIG. 12 is an example where three U-turn headers (the "third headers") 26*a*, 26*b*, and 26*c* are used to circulate the refrigerant F supplied from the inflow-side header 7 to an outflow-side header 8 provided in the same direction as the inflow-side header 7. In the heat exchanger 1*d*, the plurality of flat tubes 3 disposed in the minor axis direction A are divided in the minor axis direction A into four sections R1 to R4, and parts 15*a* to 15*e* where the end parts 5 and 6 of the respective flat tubes 3 are gathered together or grouped at narrow intervals P2 in the minor axis direction A are formed and connected to the U-turn headers 26*a*, 26*b*, and 26*c* and the headers 7 and 8. Out of a part that protrudes from the fins 2 to the right (outward), the part 15*d* where the end parts 6 of the flat tubes 3 in the section R1 positioned closest to the bottom are grouped together is connected to the inflow-side header 7, the sections R1 and R2 are connected by the header 26*a* to which the grouped part 15*a* is attached, the sections R2 and R3 are connected by the header 26*b* to which the grouped part 15*c* is attached, the sections R3 and R4 are connected by the header 26*c* to which the grouped part 15*b* is attached, and the part 15*e* where the end parts 6 of the flat tubes 3 in the section R4 closest to the top are grouped together is connected to the outflow-side header 8. In the heat exchanger 1*d*, the refrigerant F supplied to the header 7 from a lower side (an end or corner) in the minor axis direction (the "first direction") A outside the heat exchange section 4 flows, as shown by the white arrows, in order through the flat tubes 3, the U-turn header 26*a*, the flat tubes 3, the U-turn header 26*b*, the flat tubes 3, the U-turn header 26*c*, and the flat tubes 3, and reaches the outflow-side header 8 disposed at an upper side (an end or corner) in the minor axis direction (the "first direction") A outside the heat exchange section 4.

With the above construction, in the heat exchanger 1*d* in which flow paths are formed using U-turn headers, all of the tube lengths from the inflow-side header 7 to the outflow-side header 8 can be made equal. A heat exchanger that uses U-turn headers is not limited to this embodiment. In an example of a heat exchanger that uses a single U-turn header includes a first header (an inflow-side header) to which first ends of some out of a plurality of flat tubes are connected, a second header (an outflow-side header) to which first ends of other flat tubes are connected, and a third header (a U-turn header) to which other ends of all of the flat tubes are connected, with the first and second headers being disposed at respective sides in a first direction outside the heat exchange-section and the third header being disposed in a central vicinity in the first direction outside the heat exchange section.

Figure 13:
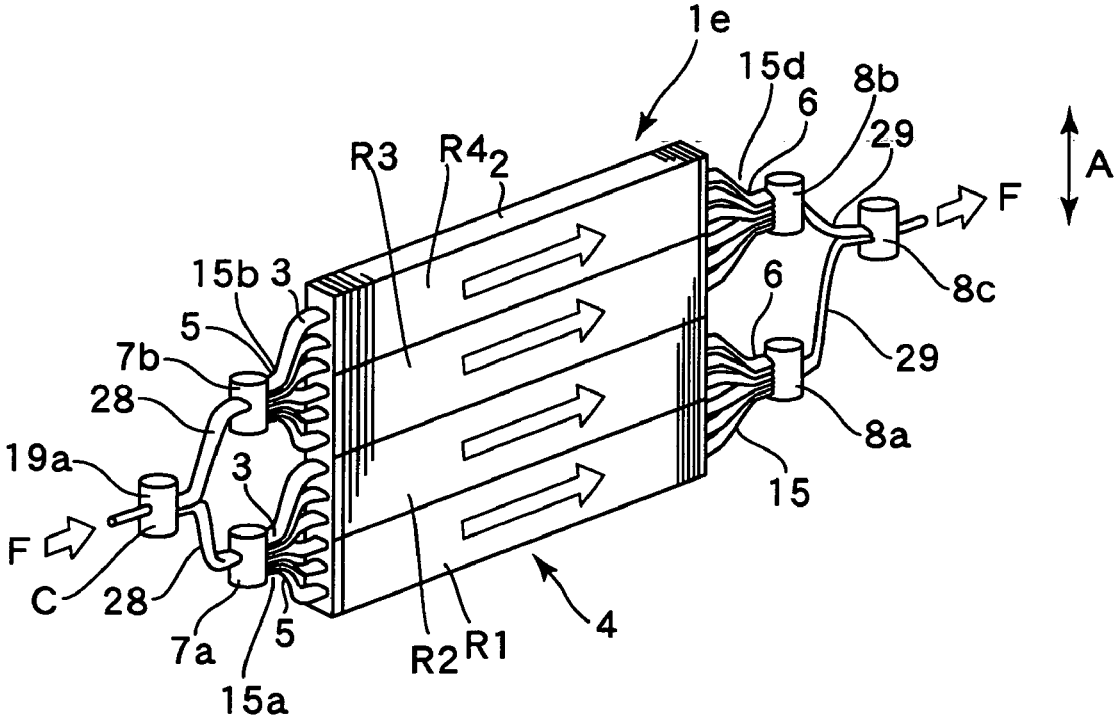
FIG. 13 is a diagram showing yet another example of a heat exchanger.
Figure 14:
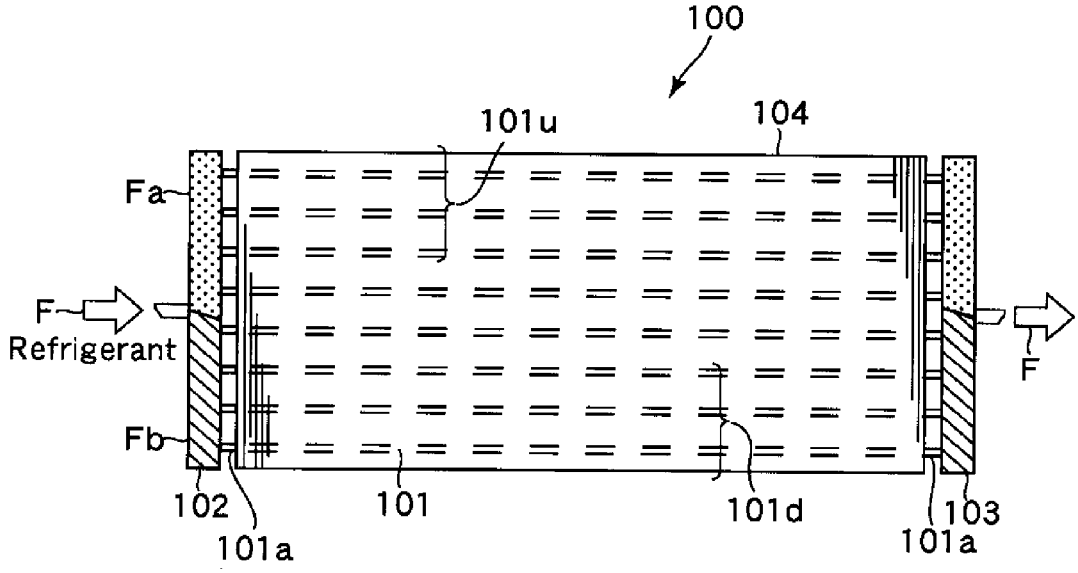
FIG. 14 is a diagram showing a conventional heat exchanger.
Figure 15:
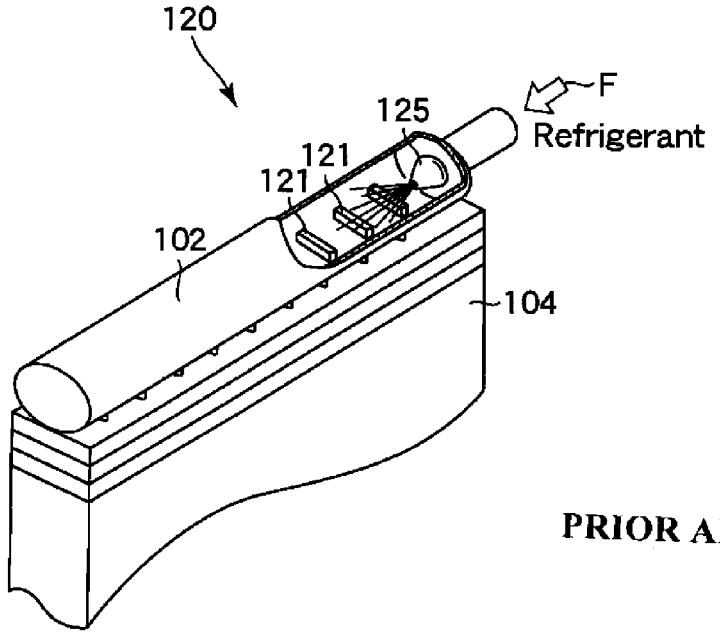
PRIOR ART Fig. 15
FIG. 15 is a diagram showing a heat exchanger where a jet orifice is incorporated in the header.
Figure 16A:
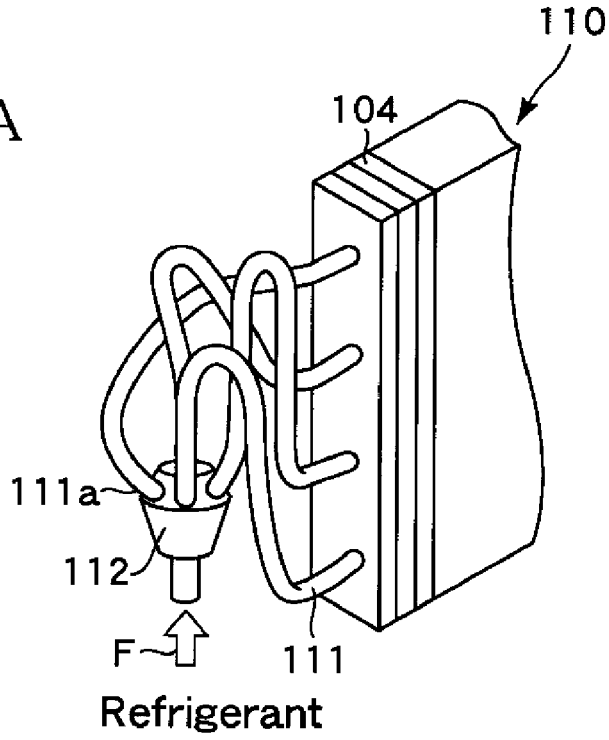
FIG. 16 is a diagram showing a heat exchanger that uses round tubes and a refrigerant distributor.
Figure 16B:
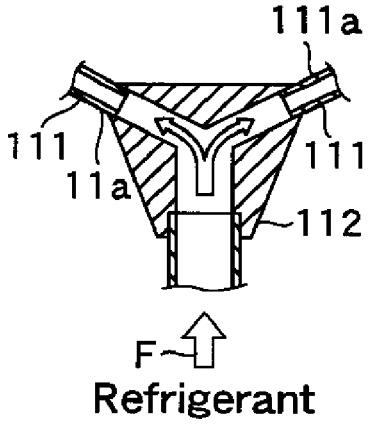
PRIOR ART Fig. 16B

The heat exchanger 1*e* shown in FIG. 13 is an example where out of the four sections R1 to R4 of the heat exchanger 1*d* shown in FIG. 12, the flat tubes 3 are connected to connecting headers by grouping the upper two sections R1 and R2 and the lower two sections R3 and R4, with the connecting headers being connected to a single inflow-side header 7*c* and a single outflow-side header. In the heat exchanger 1*e*, the plurality of flat tubes 3 arranged in the minor axis direction A are divided into four sections R1 to R4, and parts 15*a* to 15*d* are formed by grouping the end parts 5 and 6 of the respective flat tubes 3 at narrow intervals P2 in the minor axis direction A. The parts 15*a* and 15*b* on the inflow side are connected to different connecting headers 7*a* and 7*b* and the parts 15*c* and 15*d* on the outflow side are connected to different connecting headers 8*a* and 8*b*. The two connecting headers 7*a* and 7*b* on the inflow side are connected to a single header 7*c* by connecting pipes or distributing pipes 28 and the refrigerant F supplied to the header 7*c* is distributed to the connecting headers 7*a* and 7*b* and is supplied from the individual connecting headers 7*a* and 7*b* to the individual flat tubes 3. The two connecting headers 8*a* and 8*b* on the outflow side are connected to a single header 8*c* by connecting pipes or distributing pipes 29 and the refrigerant F that flows out of the connecting headers 8*a* and 8*b* flows to the single header 8*c*. In this kind of heat exchanger 1*e*, it is possible to make the sizes of the individual headers 7*a* to 7*c* and 8*a* to 8*c* smaller, and the phase state of the refrigerant inside the headers can be made more uniform.

It should be noted that although a heat exchange section that includes plate-like fins 2 has been described for the present invention, the invention is not limited to the heat exchanger with fins being plate-like and can be applied to any heat exchanger that uses flat tubes.

INDUSTRIAL APPLICABILITY

According to the present invention, it is possible to provide a heat exchanger that uses flat tubes and is compact and has higher heat exchange efficiency. The present invention can be applied to all heat exchanging apparatuses such as air-conditioners, radiators, various kinds of refrigeration apparatuses, and various kinds of cooling apparatuses.

The invention claimed is:

1. A heat exchanger comprising:

a heat exchange section in which a plurality of flat tubes are arranged substantially in parallel in a minor axis direction of the plurality of flat tubes at first intervals with fins disposed between the plurality of flat tubes so as to pass an external fluid in a major axis direction of the plurality of flat tubes; and a header to which at least some flat tubes out of the plurality of flat tubes are connected, the at least some flat tubes protruded from the fins are different in length, the parts of the at least some flat tubes are bent in S-like shape in the minor axis direction between the heat exchange section and the header, end parts of the at least some flat tubes that are connected to the header are gathered and arranged substantially in parallel in a same direction of the heat exchange section at second intervals that are narrower than in the heat exchange section and the minor axis direction of the end parts of the at least some flat tubes and a central axis direction of the header are the same direction.

2. A heat exchanger according to claim 1, wherein the end parts of the at least some flat tubes are bundled in the minor axis direction.

3. A heat exchanger according to claim 1, wherein the end parts of the at least some flat tubes are integrated in a bundled state and connected to the header.

4. A heat exchanger according to claim 1, wherein at the end parts of the at least some flat tubes, gaps between respective end parts are approximately equal to or smaller than a diameter of the flat tubes in the minor axis direction.

5. A heat exchanger according to claim 1, wherein the end parts of the at least some flat tubes are arranged so as to be substantially touching in the minor axis direction.

6. A heat exchanger according to claim 1, further comprising a first header to which end parts at one end of the plurality of flat tubes are connected and a second header to which end parts at another end of the plurality of flat tubes are connected, wherein the first header and the second header are disposed with respect to the heat exchange section so that tube lengths of the plurality of flat tubes between the first header and the second header are substantially equal.

7. A heat exchanger according to claim 1, further comprising a first header to which end parts at one end of the plurality of flat tubes are connected and a second header to which end parts at another end of the plurality of flat tubes are connected, wherein the first header and the second header are disposed at positions on a diagonal with the heat exchange section in between.

8. A heat exchanger according to claim 1, wherein in the heat exchange section, the plurality of flat tubes are arranged in a first direction, the heat exchanger further comprises a first header to which end parts at one end of some flat tubes out of the plurality of flat tubes are connected, a second header to which end parts at the one end of other flat tubes out of the plurality of flat tubes are connected, and a third header to which end parts at another end of the plurality of flat tubes are connected, and the first and second headers are disposed at respective sides in the first direction outside the heat exchange section and the third header is disposed in a central vicinity in the first direction outside the heat exchange section.

9. A heat exchanger according to claim 1, further comprising a plurality of headers and at least one distributor to which the headers are connected.

10. A heat exchanging system comprising:

a heat exchanger according to claim 1; and means for supplying a heat exchange medium to the heat exchanger.

11. A heat exchanger comprising:

a heat exchange section in which a plurality of flat tubes are arranged substantially in parallel in a minor axis direction at first intervals with fins disposed between the flat tubes; and a header to which at least some flat tubes out of the plurality of flat tubes are connected in a state where the at least some flat tubes are bent in the minor axis direction outside the heat exchange section and end parts of the at least some flat tubes are arranged substantially in parallel at second intervals that are narrower than in the heat exchange section so that the minor axis direction and a central axis direction of the header are the same direction, wherein in the heat exchange section, the plurality of flat tubes are arranged in a first direction, the heat exchanger further comprises a first header to which end parts at one end of some flat tubes out of the plurality of flat tubes are connected, a second header to which end parts at the one end of other flat tubes out of the plurality of flat tubes are connected, and a third header to which end parts at another end of the plurality of flat tubes are connected, and the first and second headers are disposed at respective sides in the first direction outside the heat exchange section and the third header is disposed in a central vicinity in the first direction outside the heat exchange section.

* * * * *